US006468108B1

(12) United States Patent
Wu

(10) Patent No.: US 6,468,108 B1
(45) Date of Patent: Oct. 22, 2002

(54) ELECTRICAL CONNECTOR WITH IMPROVED BOARD LOCKS

(75) Inventor: Jerry Wu, Pan-Chiao (TW)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 09/912,850

(22) Filed: Jul. 24, 2001

(51) Int. Cl.[7] ..... H01R 13/60; H01R 13/66; H01R 13/73; H01R 1/01; H01R 13/648

(52) U.S. Cl. ..... 439/567; 439/572; 439/607

(58) Field of Search ..... 439/567, 572, 439/357, 358, 607, 939, 352, 544, 555, 108

(56) References Cited

U.S. PATENT DOCUMENTS 5,094,624 A * 3/1992 Bakke et al. ..... 439/326
5,827,089 A * 10/1998 Beck, Jr. ..... 439/567
6,287,146 B1 * 9/2001 Avery et al. ..... 439/607

* cited by examiner

*Primary Examiner*—Khiem Nguyen
*Assistant Examiner*—Chandrika Prasad
(74) *Attorney, Agent, or Firm*—Wei Te Chung

(57) ABSTRACT

An electrical connector (1) comprises an insulative housing (2) defining a number of passageways (220) with a number of contacts (3) received therein, a pair of rearwardly extending projections (26), and a pair of board locks (4) retained in the housing. Each projection defines a channel (2600) therein. Each board lock comprises a front contact portion (40) for contacting with a corresponding ground contact of a complementary connector, and a rear tail portion (46) for connection with a printed circuit board. The tail portion includes a L-shaped anchoring device (460) for being fittingly received and retained in the channel of a corresponding projection to prevent the tailportion of the board lock from warping upwardly, and a pair of legs (462) at a free end thereof for being inserted into corresponding through holes of the printed circuit board.

17 Claims, 5 Drawing Sheets

ELECTRICAL CONNECTOR WITH IMPROVED BOARD LOCKS

BACKGROUND OF THE INVENTION

1. Field of the Invention

The present invention relates to an electrical connector with board locks, and particularly to an SCA-2 connector with board locks that can make the SCA-2 connector stably mounted on a printed circuit board.

2. Description of Related Art

SCA-2 (single connector attachment) connectors provide a standard interface between SCSI (Small Computer System Interface) disk drives, Fiber Channel disk drives, GBIC (Gigabit Interface Converter) modules and back-plane systems. The SCA-2 connectors can be classified into three types, i.e., 20-pin, 40-pin and 80-pin SCA-2 connectors. The 20-pin SCA-2 connectors are used with GBIC modules used as media interface modules for fiber channel; the 40-pin SCA-2 connectors are used with 3.5" Fiber Channel disk drives; and the 80-pin SCA-2 connectors are used with 3.5" SCSI disk drives. A conventional SCA-2 connector comprises an insulative housing with a plurality of contacts received therein and a pair of board locks retained in the housing. Each board lock comprises a contact portion for engaging with a corresponding ground contact of a complementary SCA-2 connector, an intermediate portion perpendicularly extending from the contact portion, and a tail portion perpendicularly extending from the intermediate portion. The tail portion consists of a pair of legs for being inserted into corresponding through holes of a printed circuit board (PCB). Thus, the SCA-2 connector is mounted on the PCB via the board locks.

However, because the board lock is too long, the legs of the board lock is easy to warp upwardly when the legs are inserted into the through holes of the PCB. Therefore, the SCA-2 connector is unstably retained in the PCB before the contacts are subjected to a soldering process. This will cause the instability during the soldering process of the contacts and increase the difficulty of soldering. As a result, the electrical connection between the SCA-2 connector and the PCB may be unreliable and the quality of signal transmission therebetween may be adversely affected. Hence, an electrical connector with improved board locks is required to overcome the disadvantages of the related art.

SUMMARY OF THE INVENTION

Accordingly, the object of the present invention is to provide an electrical connector with board locks which can make the electrical connector stably mounted on a printed circuit board, thereby ensuring a reliable electrical connection therebetween.

Another object of the present invention is to provide an electrical connector with board locks for establishing a grounding path between a complementary connector and a printed circuit board on which the electrical connector is mounted.

In order to achieve the objects set forth, an electrical connector comprises an insulative housing defining a plurality of passageways therein, a plurality of contacts received in the passageways of the housing, and a pair of board locks retained in the housing. The housing has a pair of rearwardly extending projections. Each projection defines a channel therein. Each board lock comprises a front contact portion for contacting with a corresponding ground contact of a complementary connector and a rear tail portion for connection with a printed circuit board. The rear tail portion includes an anchoring device and a pair of spaced legs for being compliantly inserted into corresponding through holes of the printed circuit board. The anchoring device is received and retained in the channel of the projection to prevent the legs of the board lock from warping upwardly. Thus, the electrical connector is stably retained on the printed circuit board before the contacts are subjected to a soldering process. Meanwhile, the rear tail portion of the board lock is connected with grounding circuits of the printed circuit board, whereby a grounding path is established between the complementary connector and the printed circuit board via the board lock.

Other objects, advantages and novel features of the invention will become more apparent from the following detailed description when taken in conjunction with the accompanying drawings.

DETAILED DESCRIPTION OF THE INVENTION

Figure 1:
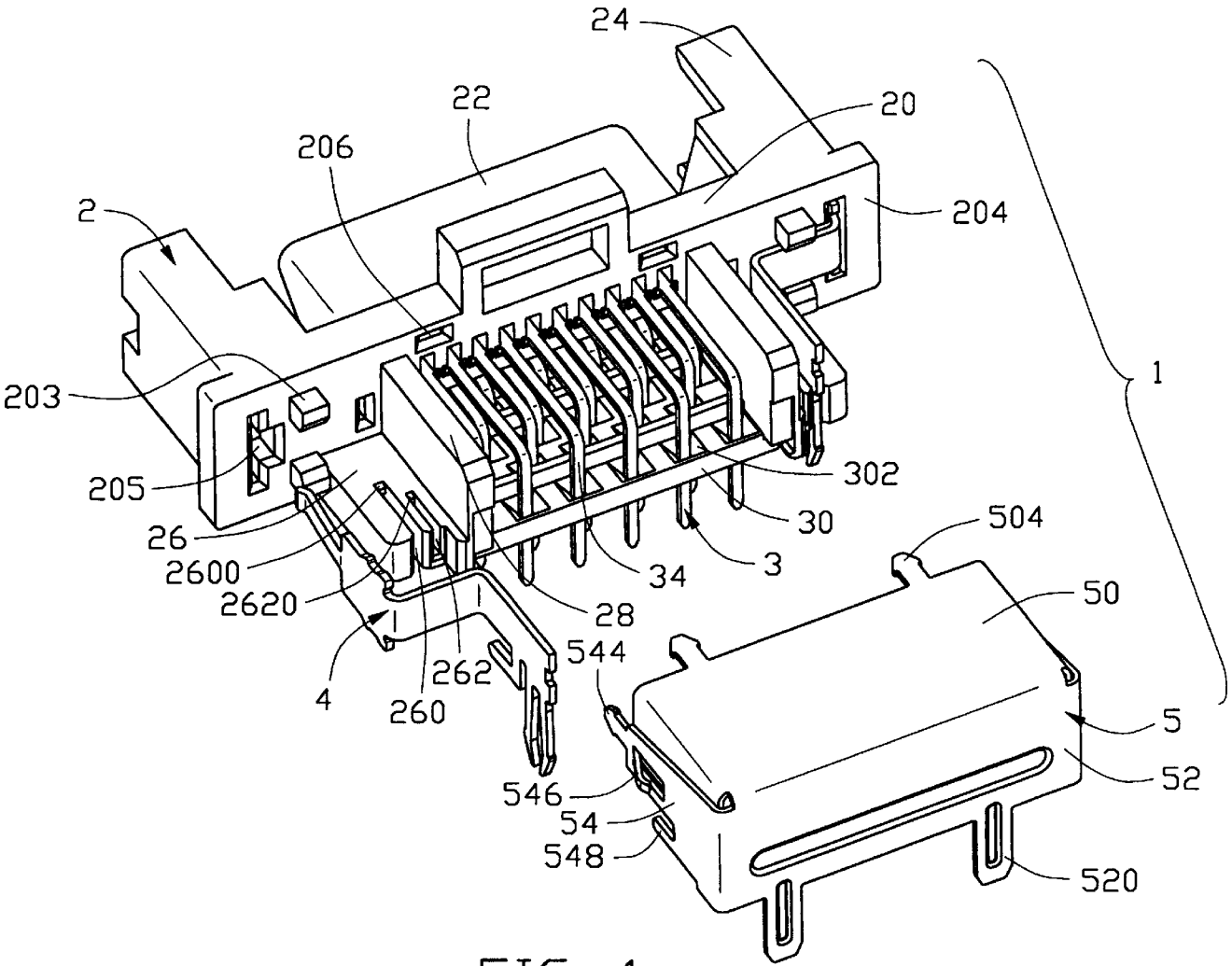
FIG. 1 is an exploded perspective view of an SCA-2 connector with a pair of board locks in accordance with the present invention.
Figure 2:
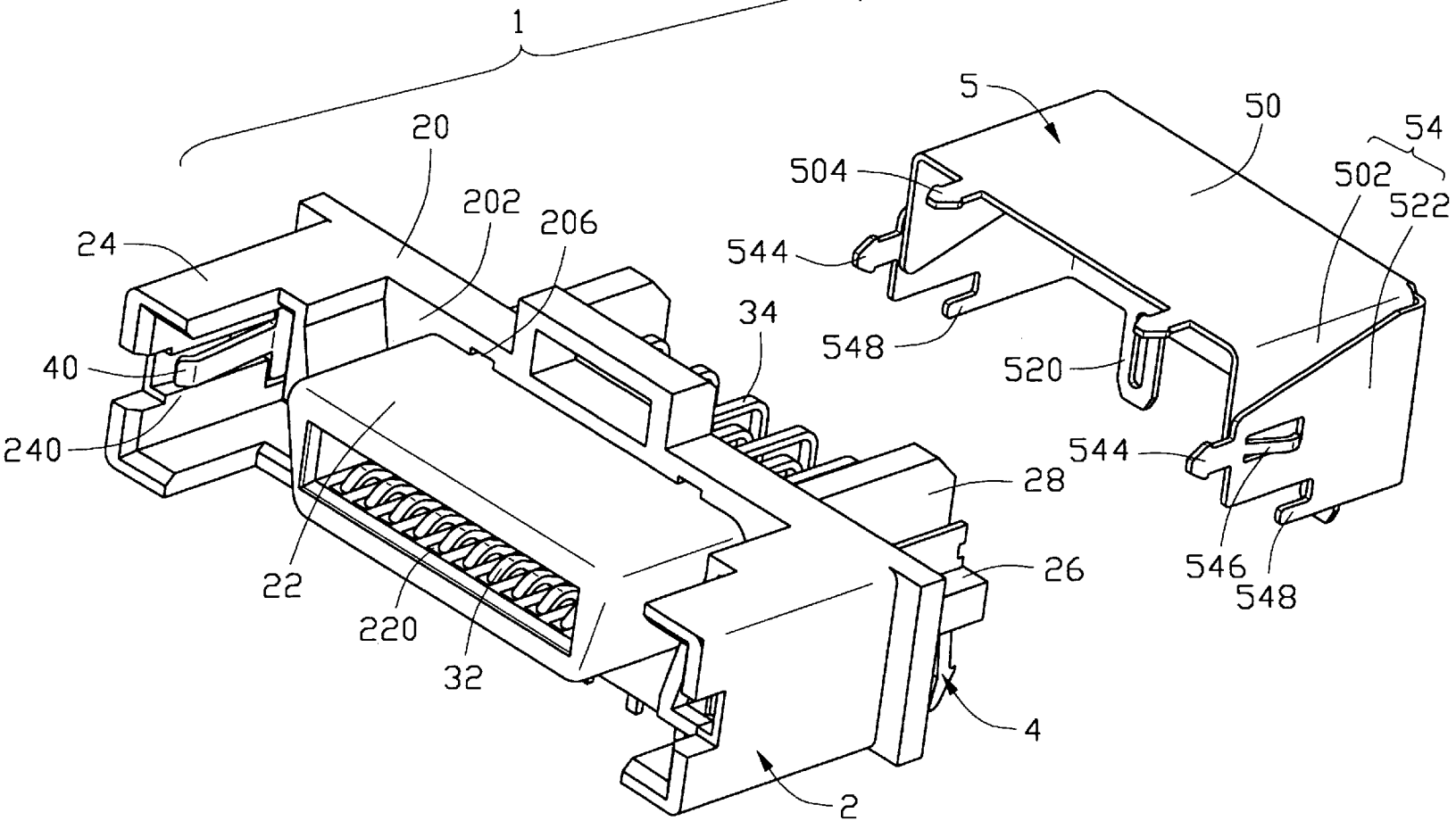
FIG. 2 is another perspective view of the SCA-2 connector shown in FIG. 1.

Referring to FIGS. 1 and 2, an SCA-2 connector 1 in accordance with the present invention comprises an insulative housing 2, a plurality of contacts 3 received in the housing 2, a pair of board locks 4 retained in the housing 2 for ESD (Electrostatic Discharge) protection, and a shield 5 attached to the housing 2. In this embodiment, the SCA-2 connector is a 20-pin SCA-2 connector used for a GBIC module. The shield 5 is optionally employed to the SCA-2 connector 1 and won't restrict the present invention.

The insulative housing 2 comprises a base section 20, a pair of side arms 24 forwardly extending from two sides of the base section 20, a mating section 22 projecting from a front surface 202 of the base section 20 between the side arms 24, and a pair of partitions 28 extending rearward from a rearsurface 204 of the base section 20. A spacer 30 is retained between the partitions 28 with a plurality of holes 302 defined in four rows in a staggered manner. The base section 20 defines four recesses 206 extending from the rear surface 204 to the front surface 202 thereof, and a plurality of passageways 220 extending into the mating section 22. Each side arm 24 defines a receiving channel 240 therein for receiving a corresponding alignment post of a complementary SCA-2 connector (not shown) to ensure a blind mating connection.

A pair of vertically aligned protrusions 203 are formed on the rear surface 204 of the base section 20 adjacent to each partition 28. A projection 26 extends rearward from a lower portion of the base section 20 between the protrusions 203 and the partition 28. The projection 26 defines a cutout 260 in a direction parallel to the partition 28, a recess 262 adjacent to the cutout 260, a channel 2600 inwardly extending from a stop surface of the cutout 260, and a slot 2620 inwardly extending from a stop surface of the recess 262.

The base section 20 further defines a pair of chambers 205 extending from the rear surface 204 of the base section 20 to respectively join with the receiving channel 240 of a corresponding side arm 24.

The contacts 3 are received in the passageways 220 of the housing 2. Each contact 3 has a front curved engaging portion 32 received in the mating section 22, a retention portion (not shown) retained in the base section 20, and a rear right-angle bent tail portion 34 extending through a corresponding hole 302 of the spacer 30 for connection with a printed circuit board (not shown). The front engaging portions 32 of the contacts 30 are adapted to mate with corresponding contacts (not shown) of the complementary connector to establish an electrical connection therebetween. The tail portions 34 are arranged in four rows in a staggered manner corresponding to the arrangement of the holes 302 of the spacer 30.

The shield 5 encloses around the partitions 28 and the rear right-angle bent tail portions 34 of the contacts 3 therebetween. The shield 5 comprises a top wall 50, a rear wall 52 downwardly extending from the top wall 50, and a pair of opposite side walls 54. Each side wall 54 is composed of a first side portion 502 downwardly extending from the top wall 50 and a second side portion 522 forwardly extending from the rear wall 52. The second side portion 522 overlaps the first side portion 502. Both the top wall 50 and the second side portions 522 of the side walls 54 are provided with a plurality of retaining tabs 504, 544 at a front edge thereof for being inserted into the recesses 206 of the housing 2. Each second side portion 522 further comprises a rearwardly and outwardly extending spring tang 546 stamped therefrom, and a forwardly extending finger 548 below the spring tang 546. The rear wall 52 has a pair of downwardly extending pins 520 for connection with grounding circuits of the printed circuit board.

Figure 3:
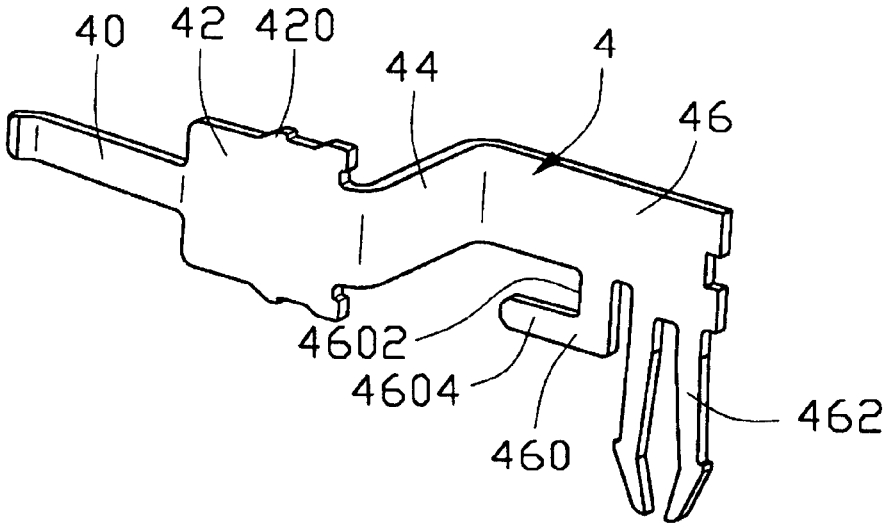
FIG. 3 is a perspective view of a corresponding board lock shown in FIG. 1.

Further referring to FIG. 3, each board lock 4 comprises a front contact portion 40 received in the receiving channel 240 of a corresponding side arm 24 for contacting with a corresponding ground contact (not shown) along the alignment post of the complementary connector, a fixed portion 42 extending from the front contact portion 40 to be retained in a corresponding chamber 205, an intermediate portion 44 perpendicularly extending from the fixed portion 42 for being retained between a corresponding pair of protrusions 203, and a rear tail portion 46 perpendicularly extending from the intermediate portion 44 and parallel with the partition 28. The fixed portion 42 of the board lock 4 has barbs 420 formed thereon for engaging with the base section 20 of the housing 2.

The rear tail portion 46 includes an anchoring device 460 for being received in the cutout 260 of the projection 26, and a pair of spaced legs 462 coplanar with the anchoring device 460 at a free end thereof for being compliantly inserted into corresponding through holes (not shown) in the printed circuit board. The anchoring device 460 is L-shaped and comprises an interconnecting portion 4602 integrally connecting with the tail portion 46 and a forwardly extending portion 4604 received in the channel 2600 of the projection 26.

Figure 4:
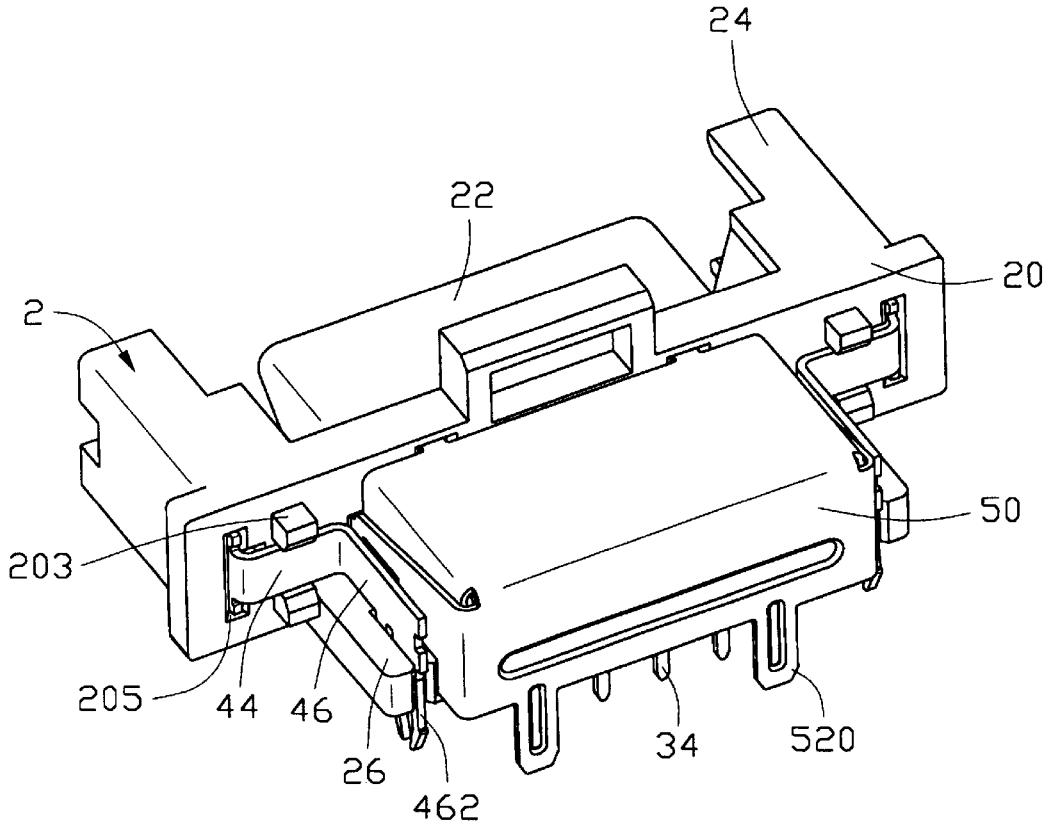
FIG. 4 is an assembled view of FIG. 1.
Figure 5:
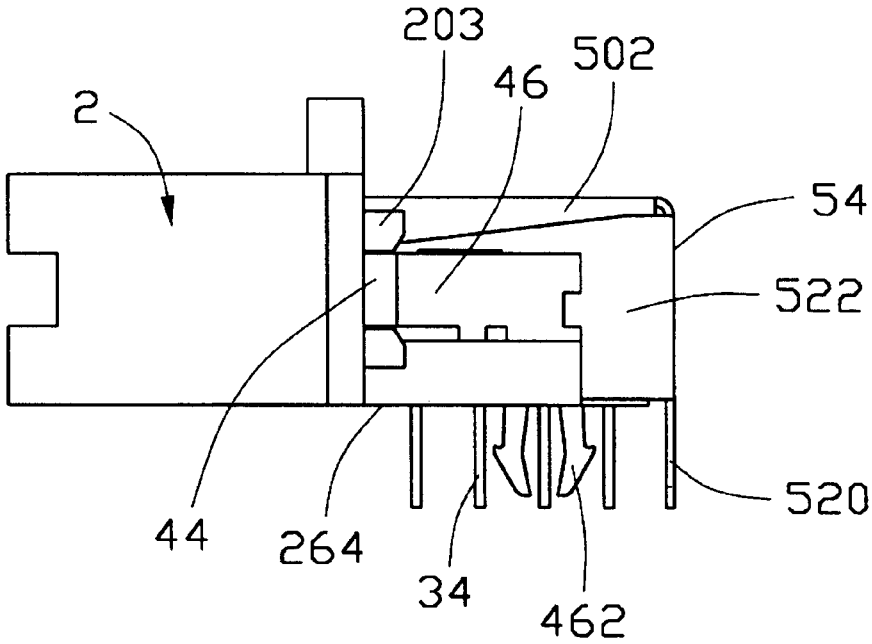
FIG. 5 is a side, plan view of FIG. 4.

Also referring to FIGS. 4–5, in assembly, the shield 5 is assembled to the housing 2 from the rear side. The retaining tabs 504, 544 of the top wall 50 and the side walls 54 are received and retained in the recesses 206 of the base section 20. The finger 548 of each side wall 54 is fittingly received in the slot 2620 of a corresponding projection 26. Therefore, the shield 5 is firmly fixed to the housing 2.

The board locks 4 are assembled to the housing 2 from the rear side too. The front contact portion 40 of the board lock 4 extends into the receiving channel 240 of the side arm 24 and projects beyond the mating section 22 of the housing 2; the fixed portion 42 is received in the chamber 205 and the barbs 420 of the fixed portion 42 engages with the base section 20 of the housing 2; the intermediate portion 44 is retained between the pair of protrusions 203; the tail portion 46 is fittingly retained in the cutout 260 of the projection 26 to restrict lateral movements thereof and the forwardly extending portion of the anchoring device 460 is received and retained in the channel 2602 of the projection 26 to prevent the tail portion 46 from warping upwardly; and the legs 462 of the tail portion 46 extends through the cutout 260 to be received in the corresponding through holes in the printed circuit board. Therefore, when the legs 462 of the board lock 4 of the SCA-2 connector 1 are inserted into the corresponding through holes in the printed circuit board, the board lock 4 will not warp upwardly and the SCA-2 connector can be stably retained on the printed circuit board to ensure a stability during a soldering process of the contacts 3, whereby a reliable electrical connection between the SCA-2 connector and the printed circuit board is ensured.

When the SCA-2 connector engages with the SCA-2 complementary connector, a grounding path is established between the ground contacts of the complementary SCA-2 connector and the printed circuit board via the board locks 4, the spring tangs 546 of the shield 5 which biases against the board locks 4, and the pins 520 of the shield 5, which connect to the grounding circuits of the printed circuit board, whereby electrostatic charges are effectively discharged. In other words, the board locks 4 of the present invention also function as ground contacts.

Although in this embodiment, the grounding path between the ground contacts of the complementary SCA-2 connector and the printed circuit board is established via the board locks 4 and the shield 5, the grounding path between the ground contacts of the complementary SCA-2 connector and the printed circuit board can also be established via the rear tail portion 46 of the board lock 4, which directly connects with the grounding circuits of the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board, comprising:

an insulative housing defining a plurality of passageways and having a pair of rearwardly extending projections, each projection defining a channel therein;

a plurality of contacts received in the passageways of the housing; and a pair of board locks disposed on opposite sides of the housing, each board lock comprising a front contact portion secured to the housing for contacting with a ground contact of a complementary connector and a rear tail portion for connection with the printed circuit board, the rear tail portion including a pair of legs at a rear end thereof for being inserted into a corresponding hole of the printed circuit board and an anchoring device fittingly received and retained in the channel of a corresponding projection for preventing the legs of the tail portion of the board lock from warping upwardly when the legs are inserted into the corresponding hole of the printed circuit board wherein the anchoring device of the boardlock is L-shaped and comprises an interconnecting portion integral with the tail portion and a forwardly extending portion received in the channel of the projection.

2. The electrical connector as claimed in claim 1, wherein the board lock comprises an intermediate portion interconnecting the front contact portion with the rear tail portion.

3. The electrical connector as claimed in claim 2, wherein the housing has a pair of vertically aligned protrusions on a rear surface thereof adjacent to each projection for retaining the intermediate portion of the board lock.

4. The electrical connector as claimed in claim 3, wherein the housing comprises a pair of forwardly extending side arms, each side arm defining a receiving channel for receiving the front contact portion of the board lock to contact with a corresponding contact of a complementary connector.

5. The electrical connector as claimed in claim 4, wherein the housing has a pair of rearwardly extending partitions between the projections and a plurality of recesses forwardly extending from the rear surface thereof.

6. The electrical connector as claimed in claim 5, further comprising a shield attached to the housing and enclosing around the partitions and the contacts therebetween.

7. The electrical connector as claimed in claim 6, wherein the shield comprises a top wall, a pair of side walls and a pair of downwardly extending pins for being connected to grounding circuits of the printed circuit board on which the electrical connector is mounted, each of the side walls having a spring tang formed thereon.

8. The electrical connector as claimed in claim 7, wherein the rear tail portion of the board lock contacts a corresponding spring tang of the shield.

9. The electrical connector as claimed in claim 7, wherein the shield has a plurality of retaining tabs forwardly projecting from the side and top walls for being received in the recesses of the housing.

10. The electrical connector as claimed in claim 7, wherein the shield comprises a rear wall downwardly extending from the top wall, the pins downwardly extending from the rear wall.

11. An electrical connector for use with a printed circuit board, comprising:

an insulative housing defining a base section with a pair of side arms forwardly extending from two opposite ends of the base section;

a plurality of contacts disposed in the base section, each of said contacts including a tail portion extending rearwardly beyond a rear surface of the base section;

a pair of projections rearwardly extending from the rear surface of the base section;

a shield forwardly attached to the rear surface of the base section in a back-to-front direction and enclosing said tail portions of the contacts;

a pair of board locks forwardly assembled to the pair of corresponding projections, respectively, in said back-to-front direction; and a spring tang extending from the shield to mechanically and electrically interconnect said shield and a corresponding board lock.

12. The connector as claimed in claim 11, wherein each of said board locks defines a rear tail portion of which an anchoring section retainably received in the housing and a board retention section are formed.

13. The connector as claimed in claim 12, wherein said rear tail portion of the board lock is closely spaced from the shield with therebetween a space bridged by said spring tang.

14. An electrical connector for use with a printed circuit board, comprising:

an insulative housing defining a base section with a pair of side arms extending forwardly from a front surface thereof and a pair of projections extending rearwardly from a rear surface thereof, a lateral dimension between the pair of side arms being larger than that of the pair of projections; and a pair of board locks attached to the rear surface of the base section in a back-to-front direction, each of said board locks including an intermediate portion parallel to the rear surface with a fixed portion and an associated front contact portion perpendicularly extending forwardly from an outermost end thereof and with a rear tail portion perpendicularly extending rearwardly from an innermost end thereof, an anchoring device integrally extending from said tail portion and received within a channel of the corresponding projection of the housing, and a board retention device integrally formed around an distal end of the tail portion for being inserted into the printed circuit board, the anchoring device preventing the board retention device from warping upwardly when the board retention device is inserted into the printed circuit board.

15. The connector as claimed in claim 14, wherein said anchoring device is coplanar with the corresponding tail portion.

16. The connector as claimed in claim 14, wherein both of said anchoring device and said board retention device are coplanar with the corresponding tail portion.

17. The connector as claimed in claim 14, wherein the board retention device is located behind the anchoring device in said back-to-front direction.

* * * * *